US006006550A

United States Patent [19]

Singh

[11] Patent Number: 6,006,550

[45] Date of Patent: Dec. 28, 1999

[54] REVERSIBLE KNIT FABRIC FOR USE IN ATHLETIC APPAREL AND METHOD FOR MAKING SAME

[75] Inventor: Manmohan Bir Singh, Burbank, Calif.

[73] Assignee: Kronfli Spundale Mills, Inc., Vernon, Calif.

[21] Appl. No.: 09/137,338

[22] Filed: Aug. 20, 1998

[51] Int. Cl.[6] ..... D04B 9/12

[52] U.S. Cl. ..... 66/13

[58] Field of Search ..... 66/169 R, 196, 66/13; 442/304

[56] References Cited

U.S. PATENT DOCUMENTS

| | | |
|---|---|---|
| Re. 34,723 | 9/1994 | Robinson et al. . |
| 2,372,497 | 3/1945 | Johnson et al. . |
| 2,879,654 | 3/1959 | Evans . |
| 3,602,914 | 9/1971 | Castello . |
| 3,785,178 | 1/1974 | Machacek et al. . |
| 3,886,768 | 6/1975 | Anderson . |
| 4,015,451 | 4/1977 | Gajjar . |
| 4,019,350 | 4/1977 | Schmidt . |
| 4,020,654 | 5/1977 | Gajjar . |
| 4,026,130 | 5/1977 | Gajjar . |
| 4,038,840 | 8/1977 | Castello . |
| 4,040,275 | 8/1977 | Castello . |
| 4,062,204 | 12/1977 | Segundo et al. . |
| 4,172,372 | 10/1979 | Murakami . |
| 4,229,954 | 10/1980 | Blore . |
| 4,571,960 | 2/1986 | Hursh et al. . |
| 4,601,940 | 7/1986 | Fischer . |
| 4,649,722 | 3/1987 | Gajjar . |
| 4,733,546 | 3/1988 | Toda . |
| 4,891,958 | 1/1990 | Cournoyer et al. . |
| 5,027,618 | 7/1991 | Robinson et al. . |
| 5,038,585 | 8/1991 | Robinson et al. . |
| 5,150,587 | 9/1992 | Bergmann . |
| 5,191,777 | 3/1993 | Schnegg . |
| 5,209,084 | 5/1993 | Robinson et al. . |
| 5,213,863 | 5/1993 | Day et al. . |
| 5,215,807 | 6/1993 | Day et al. . |
| 5,255,538 | 10/1993 | Day et al. . |
| 5,267,454 | 12/1993 | Gregory . |
| 5,284,034 | 2/1994 | Weis et al. . |
| 5,373,713 | 12/1994 | Miller . |
| 5,422,153 | 6/1995 | Miyamoto . |
| 5,528,910 | 6/1996 | Azais . |
| 5,542,269 | 8/1996 | Richards . |
| 5,682,771 | 11/1997 | Forest et al. . |
| 5,735,145 | 4/1998 | Pernick . |

*Primary Examiner*—John J. Calvert
*Assistant Examiner*—Robert H. Muromoto, Jr.
*Attorney, Agent, or Firm*—Alston & Bird LLP

[57] ABSTRACT

A reversible knit fabric having a first surface of a first color and a second surface of a second color is described. The fabric is integrally knit on a dual-bed weft knitting machine so that each of the surfaces of the fabric is visually distinct from the other. The fabric also includes an arrangement of cellular-like mesh openings on each face thereof, so as to provide a fabric which has good breathability and appearance. In addition, the fabric has good durability, elasticity, and washability. As a result, the fabric is particularly useful in the manufacture of athletic apparel. Furthermore, because the fabric has a visually distinct appearance on each of its two sides, it can be used to produce reversible garments such as jerseys for use in scrimmages.

A process for knitting the fabric is also described.

5 Claims, 3 Drawing Sheets

REVERSIBLE KNIT FABRIC FOR USE IN ATHLETIC APPAREL AND METHOD FOR MAKING SAME

BACKGROUND OF THE INVENTION

1. Field of the Invention

The invention generally relates to a reversible weft knit fabric and its method of production. More specifically, the invention relates to a reversible weft knit fabric which has a different color on each of the fabric faces so as to provide a visually distinct appearance to each, and a knitting process for producing the fabric.

2. Description of the Prior Art

Knit fabrics are well known for their ease of manufacture, and are commonly used in the production of apparel. In particular, such fabrics are commonly used to make athletic apparel, because they generally are comfortable to wear and provide a good degree of breathability. One such use of knit fabrics is in the production of jerseys worn during athletic competitions.

In team athletic competitions, it is desirable that the competitors of one team be readily distinguishable from those of the other team. This is commonly achieved by the players of one team wearing apparel of one color while the players of the other wear differently-colored apparel. This can present a particular problem when it is desired that the player composition of the teams be varied, as it requires that either the players each have one item of each of the respectively colored items of apparel, or that players exchange shirts with each other as the teams change so that the members of each respective team are similarly attired. As can be readily recognized, this would be particularly undesirable where the composition of the teams is desired to be changed after some warm-up or play has occurred, since individuals would be forced to don the apparel worn by and perhaps perspired in by another player. As a result, teams often end up playing "shirts and skins", where the teams are distinguished by the fact that one team has on shirts while the other plays bare-chested.

One method which has been employed in an attempt to overcome the above-described disadvantages is the production of items of apparel (and in particular shirts) made from two overlying pieces of knit fabric such that one forms the inside layer of the item of apparel and the other forms the outside apparel layer. While this construction enables the ready switching by a player from one color of shirt to another as his or her team affiliation changes, the garments are generally labor intensive to produce, not capable of easy mass production, and therefore are relatively expensive to produce. Furthermore, such garments are generally heavier than otherwise required.

Thus, it would be desirable to provide a material which could be selectively reversed (that is, turned inside-out) by a player, so that they can readily and easily be identified with either of two teams.

SUMMARY OF THE INVENTION

The instant invention achieves the foregoing advantage through the provision of a knit fabric construction having a first surface of a first color, and a second surface with a second color which is distinct from and readily distinguishable from that of the first color. In addition, the fabric of the invention has good durability,

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
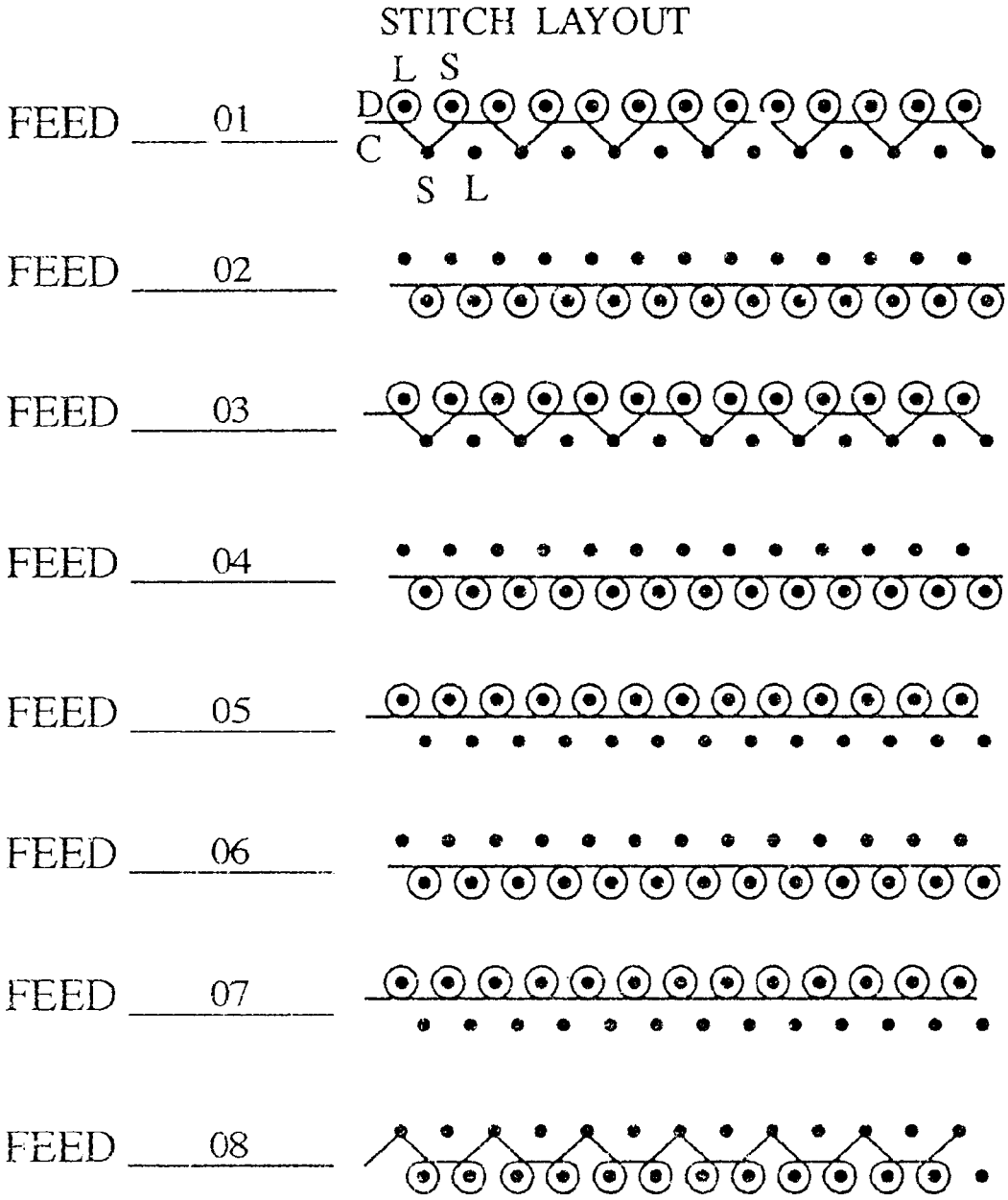
FIGS. 1A–1C combined illustrate the knitting pattern used to knit a fabric according to the process of the instant invention.
Figure 1B:
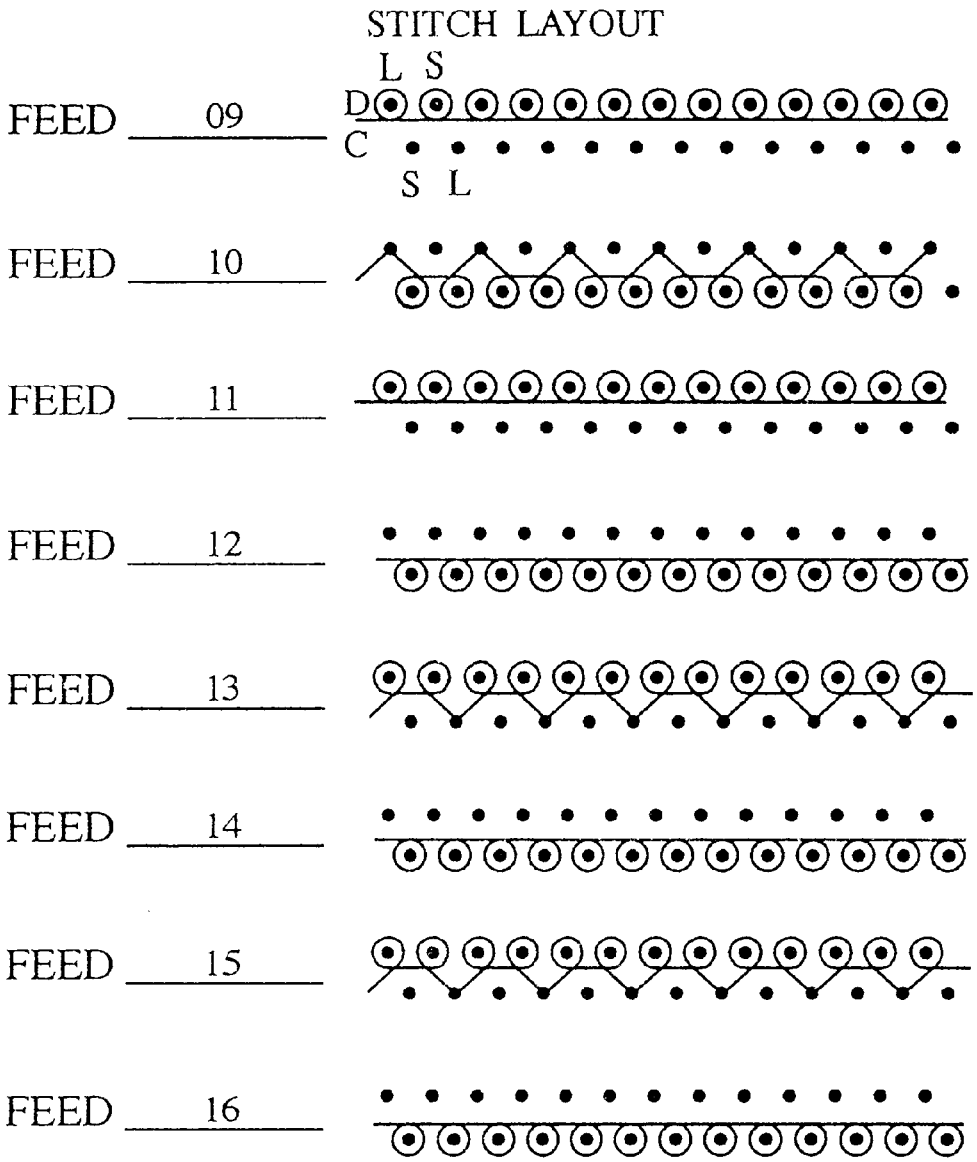
Figure 1C:
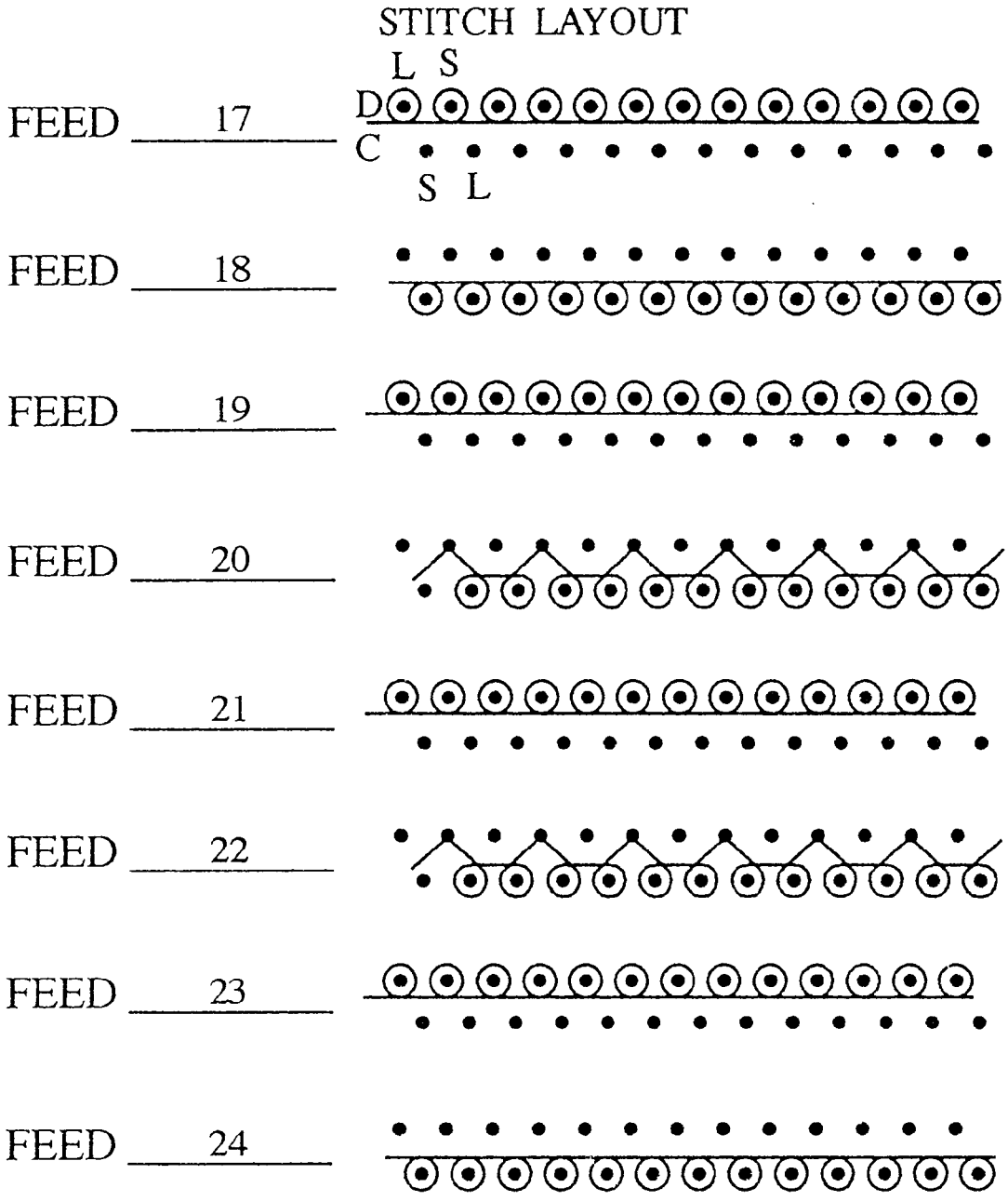

FIGS. 1A, 1B and 1C together illustrate the knitting stitch pattern used to perform the process of the instant invention to produce the fabric thereof. As illustrated, the process utilizes a dual-bed knitting machine, preferably of the circular knitting machine variety having cylinder and dial needle beds. However, as will be recognized by those of ordinary skill in the art, other forms of flat bed machines could also be used to produce the fabric, within the scope of the instant invention. In any event, circular knitting machines are preferred due to their speed, availability and the ease in which they can be set up to knit the fabric of the invention.

The knitting machine is also desirably arranged so that the respective first and second needle beds are in a rib-gating set up. As will be understood by those of skill in the art, this means that the respective needle beds are offset relative to each other, so that adjacent needles from the individual beds can be in motion at the same time, as opposed to interlock gating where the needles of one bed are directly opposite those of the other bed, such that only one needle at each position can be in operation at a given time.

Furthermore, each of the needle beds includes a plurality of needles positioned in a side-by-side arrangement, with each of the needles desirably being individually controllable for motion throughout the knitting cycle. For purposes of illustration and designation within the claims, the plurality of needles in each of the respective needle beds includes alternating odd-numbered needles separated by alternating even-numbered needles. In other words, where it is desired that only every other needle be operational (i.e. activated) during the production of a given course, it will be the case that only the even-numbered needles or the odd-numbered needles will be employed for the given knit course. In a preferred form of the invention, each of the needle beds will be arranged with alternating long and short needles (e.g. the long needles will be arranged as the even-numbered needles, while the short needles will be arranged as the odd-numbered needles.) As will be readily recognized by those of ordinary skill in the art, such an arrangement assists in the needle selection process and cam set-up during the knitting operations. For purposes of discussion, the needles will be described as cylinder and dial needles, and short and long needles, although the invention is not to be limited to only circular knitting machines or short/long needle arrangements, as described above.

The knitting sequence includes 24 feeds, each of which knits a course as follows:

Feed 1 knits on all of the needles of the first needle bed (i.e. the dial), while tucking on only the short needles of the second needle bed (i.e. the cylinder). The yarn fed has a first color, which will be described more specifically below with respect to the fabric.

Feed 2 then knits on all of the needles of the second needle bed (i.e. the cylinder) only, and does not knit or tuck behind any of the needles of the first needle bed. The yarn fed at Feed 2 desirably has a second color which is visually distinct from the first color, as will be described more fully below.

Feed 3 then knits a pattern like that of Feed 1, i.e. it knits on all of the needles of the first needle bed (i.e. the dial), while tucking behind only the odd needles (i.e. every other needle: in the illustration, the short needles) of the second needle bed (i.e. the cylinder). The yarn fed at Feed 3 is desirably of the first color, which is the same color as fed at Feed 1.

Feed 4 knits a yarn on all needles of the second needle bed (i.e. the cylinder bed), but does not cross over to the first needle bed (i.e. the dial bed). As a result, it will only appear on one of the surfaces of the knit fabric structure. The yarn fed at Feed 4 is desirably the second color (as was fed at Feed 2.)

Feed 5 knits a yarn of the first color on all needles of the first needle bed (i.e. the dial bed.)

Feed 6 knits a yarn of the second color on all needles of the second needle bed (i.e the cylinder bed), but does not cross to the first needle bed.

Feed 7 knits on all needles of the first needle bed (i.e. the dial needle bed) using a yarn having the first color.

Feed 8 knits on all of the needles of the second needle bed (i.e. the cylinder bed), and tucks behind the even numbered needles on the first needle bed (i.e. tucks behind the long needles on the dial bed), using a yarn having the second color.

Feed 9 knits on all needles of the first needle bed (i.e. the dial), using a yarn having the first color.

Feed 10, like Feed 8, knits on all needles of the second needle bed (i.e the cylinder needle bed), and tucks behind even-numbered needles on the first needle bed (i.e. the long needles on the dial needle bed) using a yarn having the second color.

Feed 11 knits a yarn of the first color on all of the needles of the first needle bed only (i.e. the dial bed.)

Feed 12 knits a yarn of the second color on all needles of the second needle bed (i.e. the cylinder needle bed) only.

Feed 13 knits a yarn of the first color on all needles of the first needle bed (i.e. the dial needle bed), while tucking behind the even-numbered needles on the second needle bed (i.e. tucking behind the long needles on the cylinder needle bed.)

Feed 14 knits a yarn of the second color on all needles of the second needle bed only (i.e. the cylinder needle bed.)

Feed 15 knits a yarn of the first color on all needles of the first needle bed, while tucking on the even-numbered needles on the second needle bed (i.e. tucking on the long needles of the cylinder needle bed.)

Feed 16 knits a yarn of the second color on all needles of the second needle bed only (i.e .the cylinder needle bed.)

Feed 17 knits a yarn of the first color on all needles of the first needle bed only (i.e. the dial needle bed.)

Feed 18 knits a yarn of the second color on all needles of the second needle bed only (i.e. the cylinder needle bed.)

Feed 19 knits a yarn of the first color on all needles of the first needle bed (i.e. the dial needle bed.)

Feed 20 knits a yarn of the second color such that it knits on all needles of the second needle bed (i.e the cylinder bed) and tucks on odd-numbered needles on the first needle bed (i.e. tucks behind the short needles on the dial needle bed.)

Feed 21 knits on all needles of the first needle bed (i.e. the dial needle bed) a yarn of the first color.

Feed 22 knits a yarn in the manner of Feed 20, that is, it knits on all needles of the second needle bed (i.e. the cylinder bed) and tucks on oddnumbered needles on the first needle bed (i.e. tucks behind the short needles on the dial needle bed.)

Feed 23 knits a yarn of the first color on all needles of the first needle bed (i.e. the dial needle bed.)

Feed 24 knits a yarn of the second color on all needles of the second needle bed (i.e. the cylinder needle bed.)

As will be readily appreciated by those having ordinary skill in the art, the courses which are knit on only a single one of the needle beds appear on a single side of the resulting knit fabric, while the courses which are knit on the needles of one needle bed and alternately tucked behind certain needles of the opposite needle bed tie the single-bed courses to the structure. As a result, a unique fabric structure having differently-colored faces is achieved. Furthermore, because of the unique knit-and-tuck pattern arrangement (i.e. where particular feeds tuck on particular alternate needles of a second needle bed), the resulting fabric has a unique arrangement of cellular-type openings on each of the two fabric surfaces. These openings provide the fabric with good ventilation capabilities, rendering it particularly advantageous for use in athletic apparel.

As noted, the fabric has good air permeability capabilities and, depending on the yarns used, a somewhat meshy appearance defined by the uniform arrangement of cellular-like openings. In addition, the fabric has good elasticity properties, is durable, and remains stable when pulled or stretched. Furthermore, the fabric has good washability characteristics, and dries quickly due to its airy nature. As a result, the fabric has particular advantages in the manufacture of athletic apparel, such as that used in running, tennis, golf, soccer, basketball, volleyball, baseball, field hockey, and other sports. In addition, the thus-produced fabrics have good hand and aesthetic characteristics, and provide comfort to a wearer when worn as a garment.

As described above, the odd-numbered feeds utilize a yarn or yarns of a first color, while the even-numbered feeds use a yarn or yarns of a second color which is visually distinct from the first color. As a result, the fabric has a first side which is a first color (corresponding to one of the two yarn colors), while the second side of the fabric is of the second color of yarn. Although described as "first" and "second" colors for purposes of clarity of description, it is to be noted that each of the first and second colors can include more than one color. For example, if desired, the second yarn color could include alternating yarns of more than one color, so as to produce a fabric having a first solid-colored side and a second striped side. Stated differently, the first time a "second color" yarn is provided, it could be of a certain shade while the second time a "second color" yarn is provided, it could be of a different shade from that of the "second color" yarn fed previously and preferably, also different from that of the first color yarn. Also, the difference in colors between the first and second colored yarns can be provided by any known means which enables the yarns forming the respective fabric surfaces to appear visually distinct from each other.

Virtually any type of yarn which can be used on a knitting machine can be used in the instant invention, including, but not limited to natural or synthetic yarns or blends thereof, textured or non-textured yarns, spun or continuous filament yarns, single or multifilament yarns, bulky or non-bulky yarns, micro-denier or non-micro-denier yarns, yarns of a single material or blended yarns, yarns of varying twist and size, etc. Furthermore, the fibers forming a part of the yarns can be of any variety and cross-sectional shape, including circular, triangular, polygonal, C-shaped, Y-shaped, petal shaped, or the like. In addition, the yarns can be treated to impart specific properties to the finished fabric, such as by processing with a hygroscopic treatment such as a surface-active agent to enhance the moisture absorbing ability of the yarns.

Also, the process can be performed on any typed of dual bed knitting machinery regardless of cut or gauge.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A process for producing a reversible fabric having a different color on each of the fabric surfaces comprising the steps of:

providing a dual bed knitting machine having first bed of needles positioned thereon and a second needle bed positioned at an angle with respect to said first needle bed such that the needles of the respective beds are capable of together knitting an integral piece of fabric, with each of said needle beds including a series of adjacent individually operable needles such that each needle bed includes first and second series of alternating odd and even numbered needles, with said machine including a plurality of yarn feeds; then knitting an integral piece of fabric by knitting first and third yarn feeds each with a yarn having a first color such that the yarn knits on all needles of said first needle bed and tucks behind the odd-numbered needles of said second needle bed;

knitting second, fourth, sixth, twelfth, fourteenth, sixteenth, eighteenth and twenty-fourth feeds each with a yarn having a second color which is visually distinct from said first color such that the yarn knits on all needles of the second needle bed only;

knitting fifth, seventh, ninth, eleventh, seventeenth, nineteenth, twenty-first and twenty-third feeds each with a yarn having said first color such that the yarn knits on all needles of the first needle bed only;

knitting eighth and tenth yarn feeds with a yarn having said second color such that the yarn knits on all needles of the second needle bed and tucks behind even-numbered needles in said first needle bed;

knitting thirteenth and fifteenth yarn feeds with a yarn having said first color such that the yarn knits on all needles of the first needle bed and tucks behind even-numbered needles in said second needle bed;

and knitting said twentieth and twenty-second yarn feeds with a yarn having said second color such that the yarn knits on all needles of the second needle bed and tucks behind odd-numbered needles in said first needle bed, to thereby produce a fabric having first and second differently colored front and back surfaces.

2. The process according to claim 1, wherein said step of providing a dual-bed knitting machine comprises providing a machine having odd-numbered needles which are shorter than said even-numbered needles.

3. The process according to claim 1, wherein said step of providing a dual-bed knitting machine comprises providing a circular knitting machine having a cylinder and a dial and wherein said first needle bed is positioned on said dial and said second needle bed is positioned on said cylinder.

4. The process according to claim 1, wherein said first and second needle beds are laterally offset relative to each other to form a rib gating arrangement.

5. A fabric made according to the process of claim 1, said fabric having an arrangement of cellular openings on each of its front and back surfaces.

* * * * *